US007021851B1

(12) United States Patent
King

(10) Patent No.: US 7,021,851 B1
(45) Date of Patent: Apr. 4, 2006

(54) TOOTHBRUSH INCORPORATING DENTIFRICE DISPENSER

(76) Inventor: Pamela King, 964B Mathis Ferry Rd., Mt. Pleasant, SC (US) 29464-2618

( * ) Notice: Subject to any disclaimer, the term of this patent is extended or adjusted under 35 U.S.C. 154(b) by 0 days.

(21) Appl. No.: 11/058,592

(22) Filed: Feb. 14, 2005

(51) Int. Cl.
*A46B 11/04* (2006.01)
*B43M 11/06* (2006.01)

(52) U.S. Cl. ..... 401/291; 401/186; 401/188 R

(58) Field of Classification Search ..... 401/183–186, 401/188 R, 172, 173, 179
See application file for complete search history.

(56) References Cited

U.S. PATENT DOCUMENTS

| | | | | |
|---|---|---|---|---|
| 642,114 | A | 1/1900 | Hall | |
| 1,563,190 | A | 11/1925 | House | |
| 1,596,365 | A | 8/1926 | Mendoza | |
| 1,988,557 | A | 1/1935 | Jecker | |
| 2,638,614 | A | 5/1953 | Anderson | |
| 3,256,894 | A * | 6/1966 | Sherman | 401/176 |
| 4,135,831 | A | 1/1979 | Reitknecht | |
| 4,622,984 | A * | 11/1986 | Gaebel | 401/175 |
| 5,115,530 | A | 5/1992 | Distiso | |
| 5,346,324 | A | 9/1994 | Kuo | |
| 5,382,106 | A | 1/1995 | Voigt | |
| 5,438,726 | A | 8/1995 | Leite | |
| 5,735,298 | A | 4/1998 | Mayne et al. | |
| 5,785,063 | A | 7/1998 | DePinto | |
| 5,827,001 | A * | 10/1998 | Taghavi-Khanghah | 401/176 |
| 5,908,257 | A | 6/1999 | Martin | |
| 6,056,466 | A | 5/2000 | Johnson et al. | |
| 6,119,296 | A | 9/2000 | Noe et al. | |
| 6,135,279 | A | 10/2000 | Dryer | |
| 6,406,207 | B1 * | 6/2002 | Wiegner et al. | 401/188 R |
| 6,685,375 | B1 | 2/2004 | Crocker | |

FOREIGN PATENT DOCUMENTS

| | | |
|---|---|---|
| DE | 4.221.438 | 7/1994 |
| GB | 2.292.377 | 3/2004 |

* cited by examiner

*Primary Examiner*—Khoa D. Huynh
(74) *Attorney, Agent, or Firm*—Michael I. Kroll

(57) ABSTRACT

A toothbrush having a conduit leading through the brush body to a plurality of egress apertures positioned within the bristle base of the brush covered by a slide tab having corresponding apertures that can be moved between an aligned open and an offset closed position to keep the dentifrice from drying out between usage's.

6 Claims, 14 Drawing Sheets

TOOTHBRUSH INCORPORATING DENTIFRICE DISPENSER

BACKGROUND OF THE INVENTION

1. Field of the Invention

The present invention relates generally to dispensers and, more specifically, to a toothbrush incorporating means for dispensing a dentifrice into the toothbrush bristles. The toothbrush has a conduit leading through the brush body to a plurality of egress apertures positioned within the bristle base of the brush covered by a slide that can be moved between an open and closed position to keep the dentifrice from drying out between usage.

Additionally, the present invention provides for an additional element wherein the toothbrush receives a canister of dentifrice that is clipped onto the toothbrush handle providing a reusable toothbrush.

2. Description of the Prior Art

There are other dispensing devices designed for tubular material. While these devices may be suitable for the purposes for which they where designed, they would not be as suitable for the purposes of the present invention as heretofore described.

It is thus desirable to provide a toothbrush having a cavity for the insertion of dentifrice that can be selectively dispensed by a user.

It is further desirable to provide a reusable toothbrush having a toothbrush body and means for receiving a tube of dentifrice that can be selectively dispensed and replaced when empty.

SUMMARY OF THE PRESENT INVENTION

A primary object of the present invention is to provide a toothbrush having dentifrice contained within the body of the brush.

Another object of the present invention is to provide a toothbrush having a conduit leading from the reservoir of dentifrice to the toothbrush bristles.

Yet another object of the present invention is to provide said conduit with a plurality of apertures leading to the toothbrush bristles.

Still yet another object of the present invention is to provide a slide positioned within the head whereby said apertures can be selectively opened and closed to prevent the dentifrice from drying out between uses.

Another object of the present invention is to provide a toothbrush having a body comprising a handle and brush head with retaining means for receiving a replaceable tube of dentifrice.

Yet another object of the present invention is to provide a mechanism whereby the dentifrice is moved from the replaceable tube through conduit to the toothbrush bristles.

Still yet another object of the present invention is to provide a toothbrush with a replaceable tube of dentifrice with a mechanism for opening and closing egress apertures within the toothbrush bristles.

Additional objects of the present invention will appear as the description proceeds.

The present invention overcomes the shortcomings of the prior art by providing a toothbrush incorporating means for dispensing a dentifrice into the toothbrush bristles. The toothbrush has a conduit leading through the brush body to a plurality of egress apertures positioned within the bristle base of the brush covered by a slide that can be moved between an open and closed position to keep the dentifrice from drying out between usage's.

Additionally, the present invention provides for an additional element wherein the toothbrush receives a canister of dentifrice that is clipped onto the toothbrush handle providing a reusable toothbrush.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
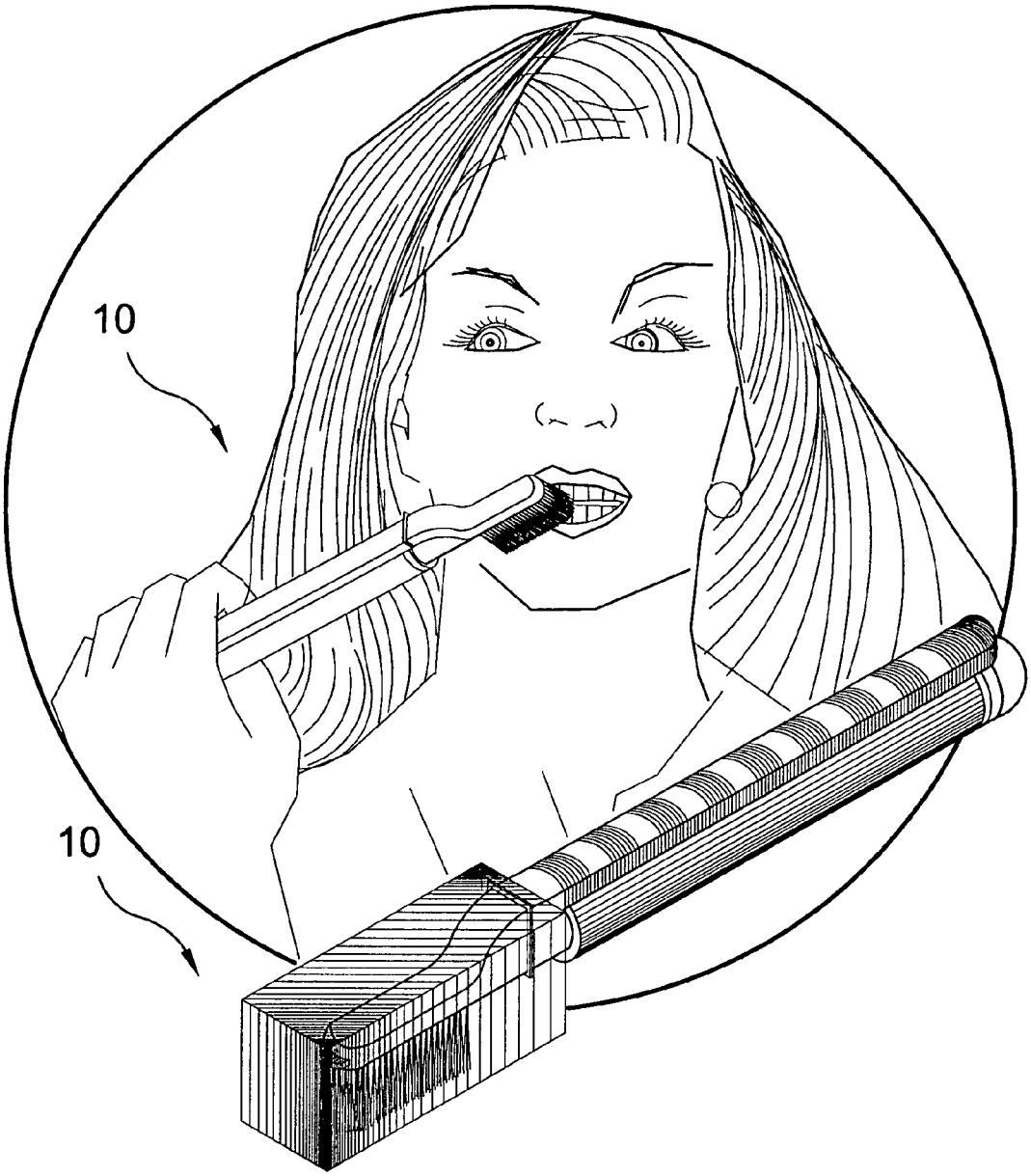
FIG. 1 is an illustrative view of the present invention in use.

Turning now descriptively to the drawings, in which similar reference characters denote similar elements throughout the several view, the figures illustrate the Toothbrush incorporating dentifrice dispenser of the present invention. With regard to the reference numerals used, the following numbering is used throughout the various drawing figures.

10 Toothbrush incorporating dentifrice dispenser
12 toothbrush handle
14 bristle head
16 bristles
18 apertures of 14
20 sliding tab
22 apertures of 20
24 toothpaste cartridge

26 toothpaste
28 injector pump
29 one-way valve
30 cartridge chamber
32 platen
34 cap
36 cap ridge
38 bristle head conduit

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention 10 is a toothbrush having a reservoir for the placement therein of toothpaste that can be selectively dispensed by the user by means of a slide mechanism positioned of the tip of the bristle head. The toothpaste reservoir has means for moving the toothpaste through the reservoir using a spring and injector pump.

Figure 2:
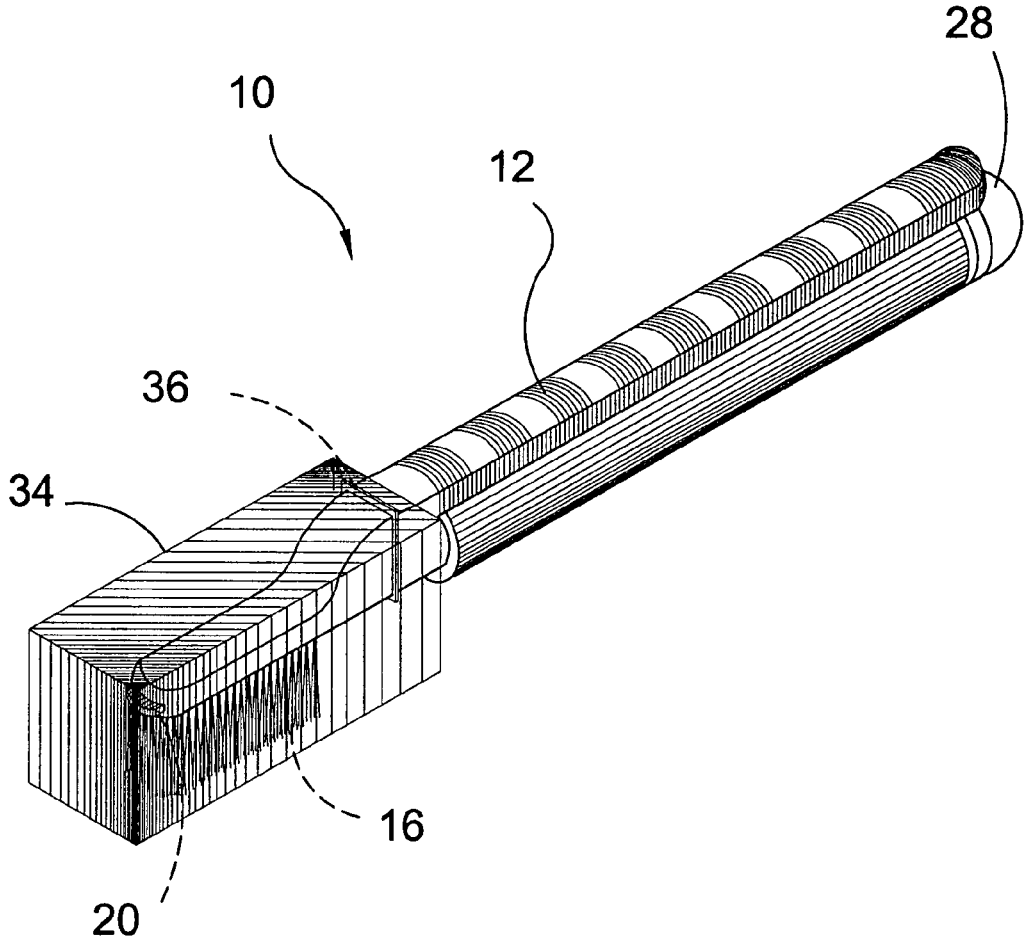
FIG. 2 is a perspective view of the present invention.

FIG. 2 is a perspective view of the present invention 10. Shown is the present invention 10 comprising a toothbrush having a reservoir for the placement therein of toothpaste that can be selectively dispensed by the user by means of a slide mechanism 20 positioned of the tip of the bristle head. Once the desired amount of dentifrice is dispensed the slide 20 is moved to the closed position for brushing and storage. The toothpaste reservoir has means for moving the toothpaste through the reservoir using a spring and injector pump 28. A cap 34 that snaps onto a cap ridge 36 is also provided to keep the bristle 16 from contamination.

Figure 3:
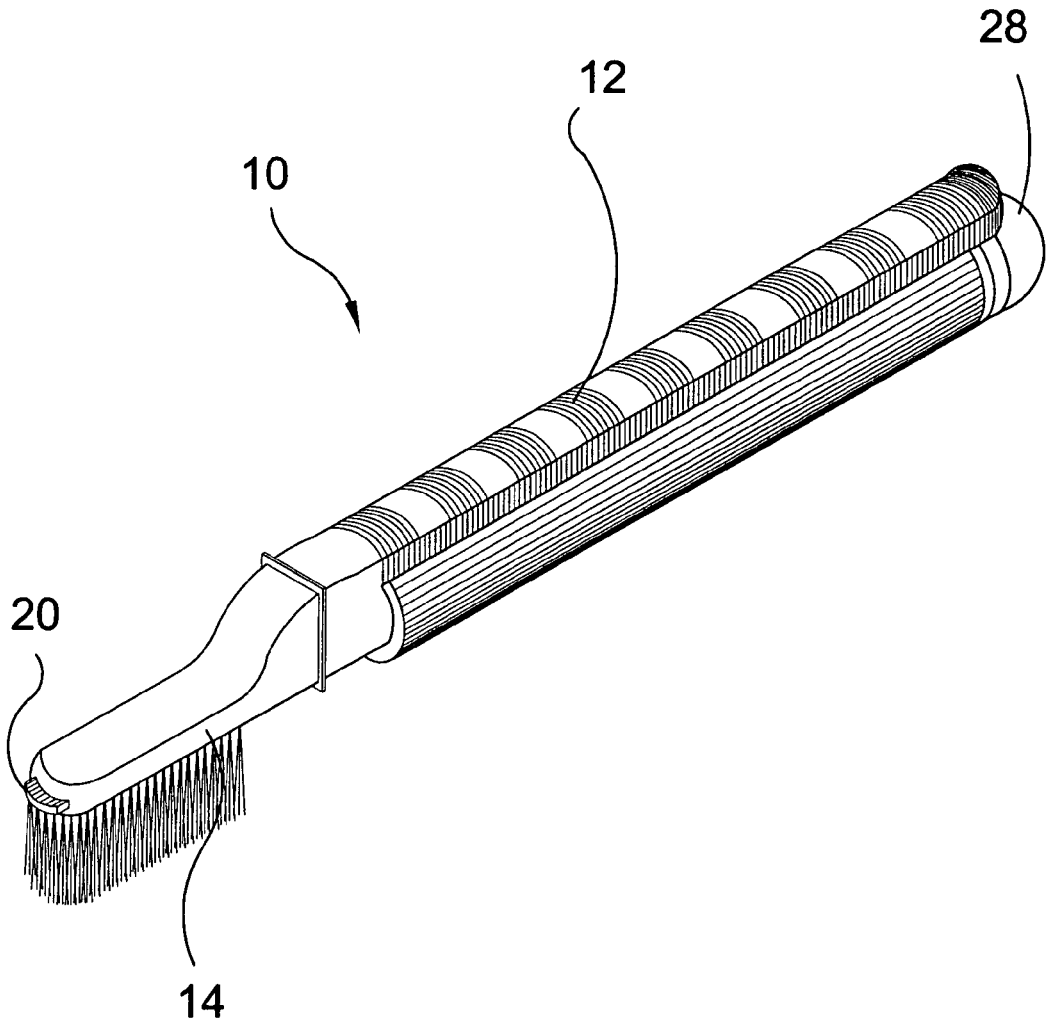
FIG. 3 is a perspective view of the present invention.

FIG. 3 is a perspective view of the present invention 10. Shown is the present invention 10 with the cap removed having a toothbrush handle 12 containing a reservoir of dentifrice that can be selectively dispensed by moving the slide 20 positioned at the bristle head 14 to the open position whereby the spring along with the injector pump 28 can be used to move the toothpaste from the reservoir through a conduit positioned within the head into the toothbrush bristles. Once the desired amount of dentifrice is dispensed the slide 20 is moved into the closed position for brushing.

Figure 4:
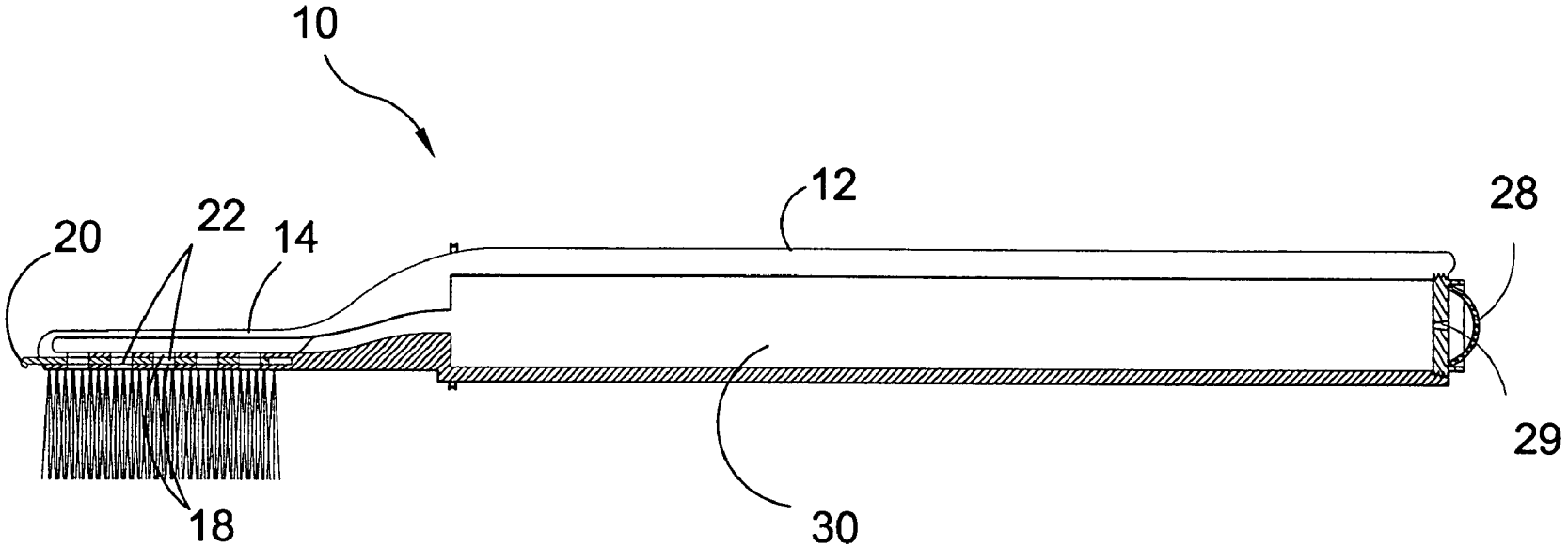
FIG. 4 is a sectional view of the present invention.

FIG. 4 is a sectional view of the present invention 10. Shown is a sectional view of the present invention 10 comprising a tooth brush having a handle 12 with a cavity therein forming a cartridge chamber 30 for the storage of toothpaste that can be selectively dispensed by the user by means of a slide mechanism 20 positioned of the tip of the bristle head 14 by aligning the slide tab apertures 22 with the bristle head apertures 18. Once the desired amount of dentifrice is dispensed the slide 20 is moved to the closed position for brushing and storage. The toothpaste reservoir has means for moving the toothpaste through the reservoir into a conduit within the brush head using an injector pump 28 with one-way valve 29 (shown schematically) when the slide 20 is in the open position.

Figure 5:
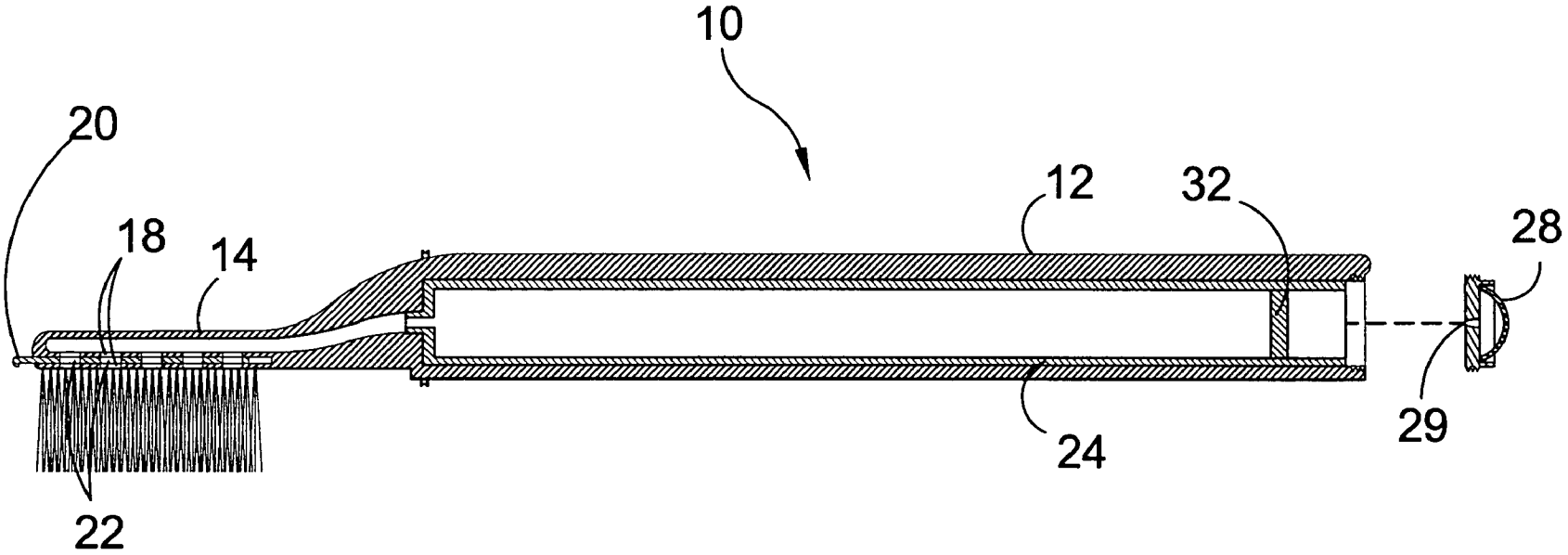
FIG. 5 is a sectional view of the present invention.

FIG. 5 is a sectional view of the present invention 10. Shown is a sectional view of the present invention 10 with the means for moving the dentifrice from the toothpaste cartridge 24 to the bristle head 14 removed from the handle 12, which provides means for refilling the toothbrush as needed. The means of selectively dispensing the dentifrice is comprised of a platen 32 conforming substantially to the reservoir bore that is in communication with an injector pump 28 having a one-way valve 29 which provides a force for moving the paste when the dispensing slide apertures 22 are moved into alignment with the bristle head apertures 18.

Figure 6:
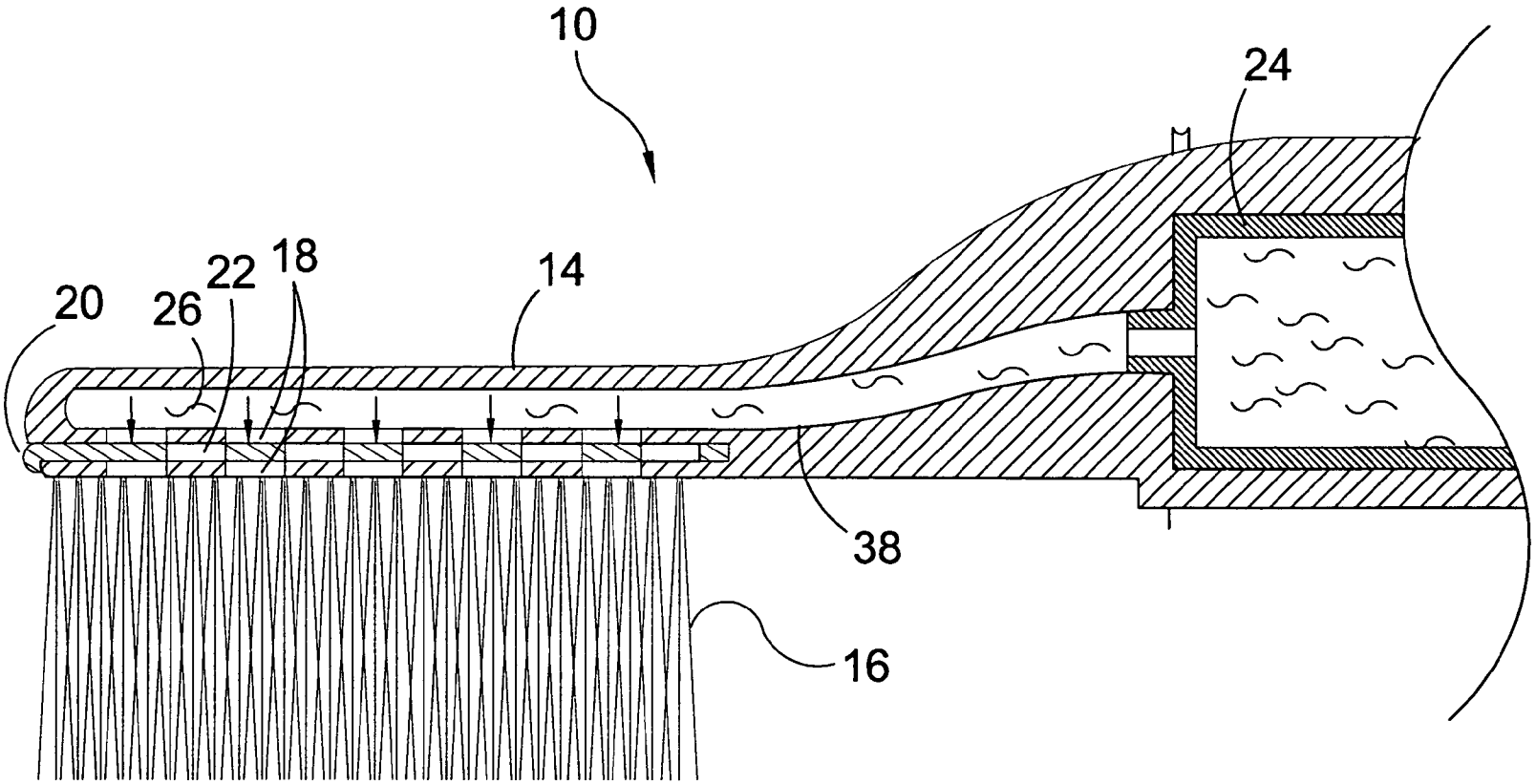
FIG. 6 is an enlarged view of the bristle head.

FIG. 6 is an enlarged view of the bristle head 14. Shown is an enlarged view of the bristle head 14 of the present invention 10 with the dispensing slide 20 in the closed position. The bristle head 14 has a conduit 38 in communication with the toothpaste cartridge 24 with a plurality of bristle head apertures 18 and slide tab apertures 22 leading into the bristles 16 with a movable dispenser slide 20 for selectively preventing or allowing the dentifrice to be moved into the bristles 16. There is a nub positioned on the front of the slide 20 to aid in selective movement of the slide from the closed to open position.

Figure 7:
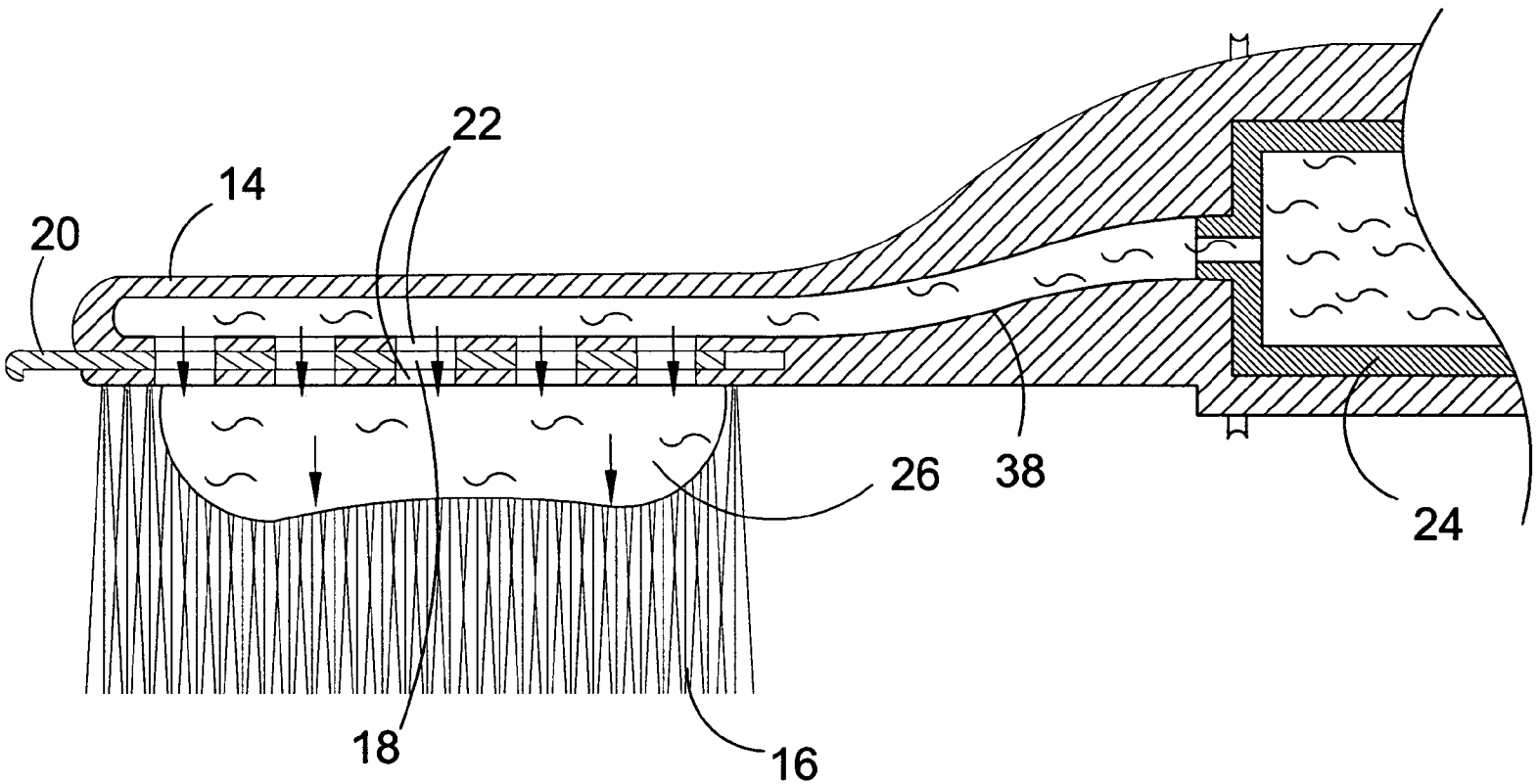
FIG. 7 is a sectional view of the present invention.

FIG. 7 is an enlarged view of the bristle head 14 of the present invention with the dispensing slide 20 in the open position. The bristle head 14 has a conduit 38 in communication with the toothpaste cartridge 24 with a plurality of bristle head apertures 18 and slide tab apertures 22 leading into the bristles 16 with a movable dispenser slide 20 for selectively preventing or allowing the dentifrice 26 to be moved into the bristles 16. There is a nub positioned on the front of the slide 20 to aid in selective movement of the slide 20 from the closed to open position. Once the desired amount of dentifrice 26 is dispensed into the bristle 16 the slide 20 is moved to the closed position for brushing and for storage.

Figure 8:
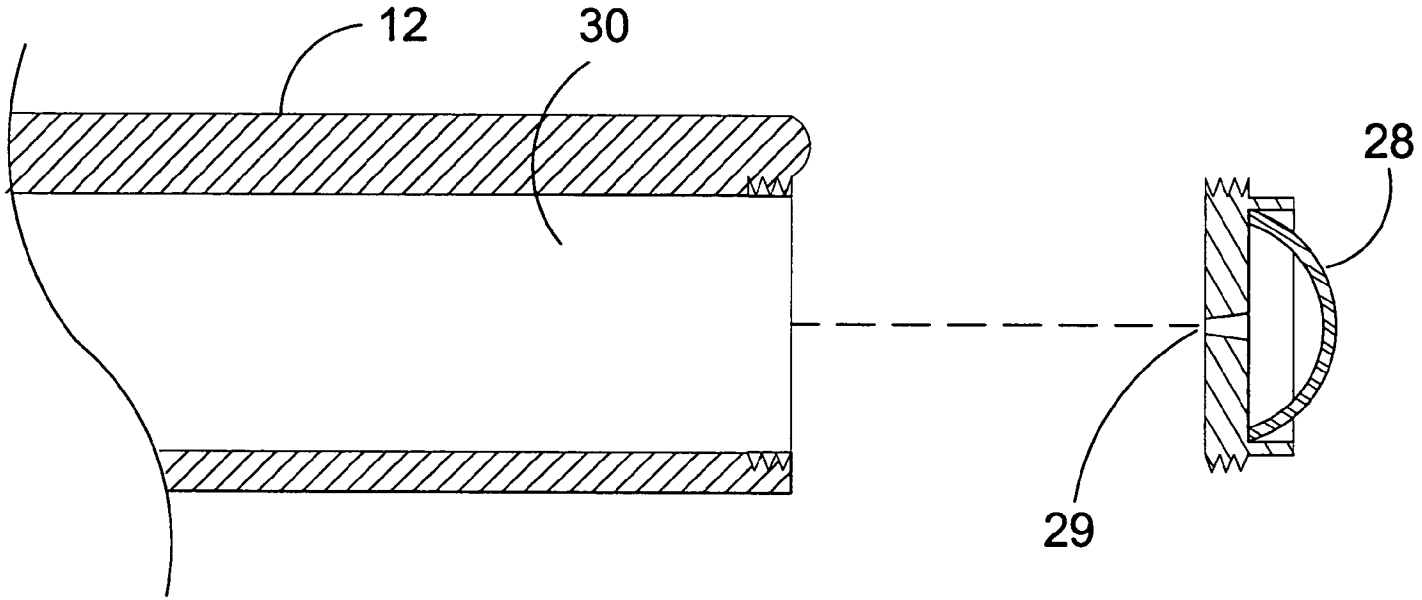
FIG. 8 is an enlarged view of the present invention.

FIG. 8 is an enlarged view of the means for moving the dentifrice from the reservoir to the bristle head removed from the handle 12, thereby providing means for refilling the toothbrush as needed. Provided is an injector pump 28 and a one way valve 29 whereby additional pressure can be exerted against the platen as necessary to dispense the dentifrice. The toothpaste cartridge is inserted into the cartridge chamber 30.

Figure 9:
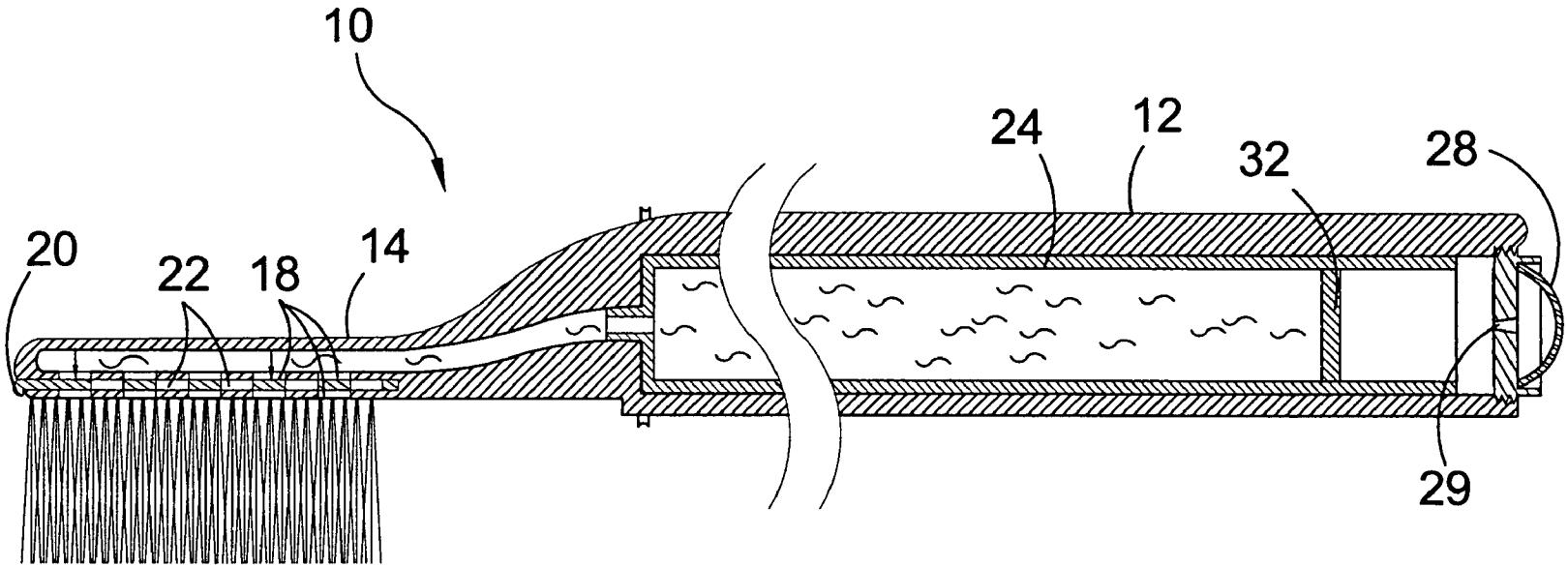
FIG. 9 is an enlarged view of the present invention.

FIG. 9 is a sectional view of the present invention 10. Shown is a sectional view of the bristle head 14 and handle 12 of the present invention 10 with the dispensing slide 20 in the closed position. The bristle head 14 has a conduit in communication with the toothpaste cartridge 24 with a plurality of bristle head apertures 18 and slide tab apertures 22 leading into the bristles 16 with a movable dispenser slide 20 for selectively preventing or allowing the dentifrice to be moved into the bristles. There is a nub positioned on the front of the slide 20 to aid in selective movement of the slide 20 from the closed to open position. As the dentifrice is dispensed the platen 32 moves through the toothpaste cartridge 24 by means of the injector pump 28 and one-way valve 29. The dispenser slide 20 in the closed position prevents any inadvertent release of the confined dentifrice.

Figure 10:
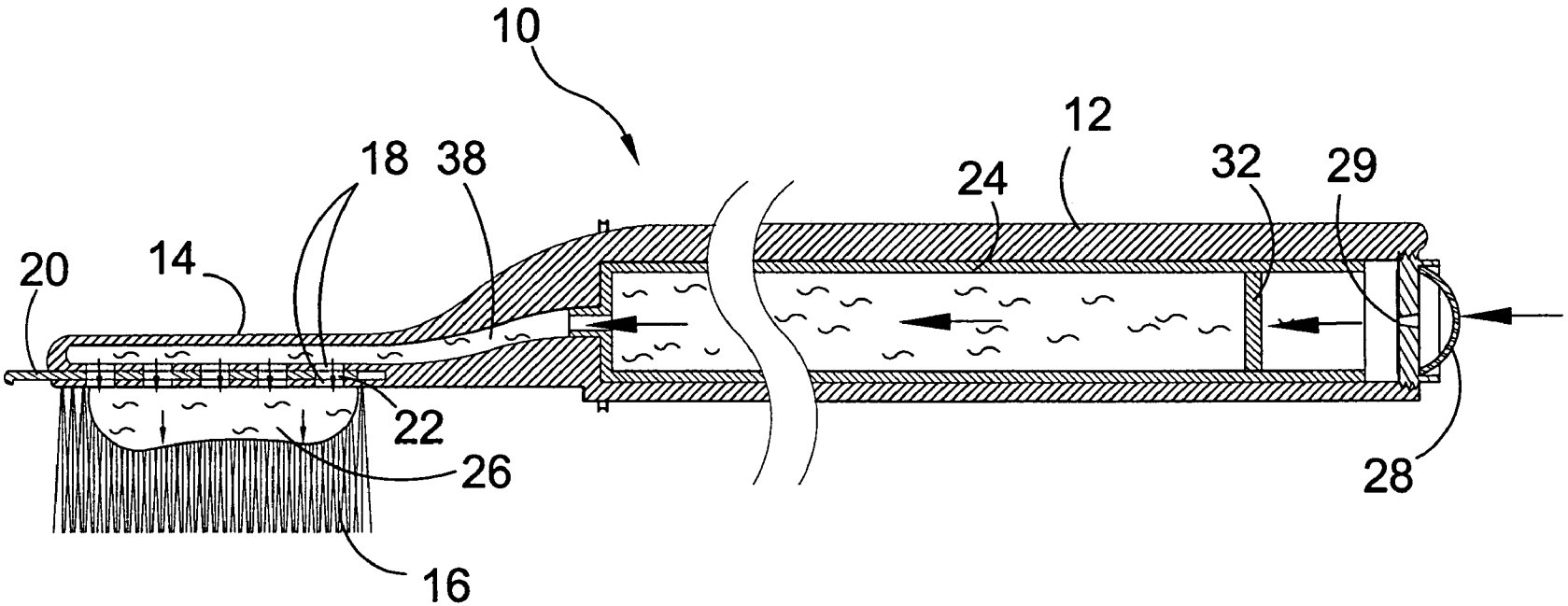
FIG. 10 is a sectional view of the present invention.

FIG. 10 is a sectional view of the present invention 10. Shown is an enlarged view of the bristle head 14 and handle 12 of the present invention 10 with the dispensing slide 20 in the open position. The bristle head 14 has a conduit 38 in communication with the toothpaste cartridge 24 with a plurality of bristle head apertures 18 and slide tab apertures 22 leading into the bristles 16 with a movable dispenser slide 20 for selectively preventing or allowing the dentifrice 26 to be moved into the bristles 16. There is a nub positioned on the front of the slide 20 to aid in selective movement of the slide 20 from the closed to open position. As the dentifrice 26 is dispensed the platen 32 advances through the toothpaste cartridge 24 by means of the injector pump 28 and one-way valve 29. The dispenser slide 20 in the closed position prevents any inadvertent release of the confined dentifrice 26.

Figure 11:
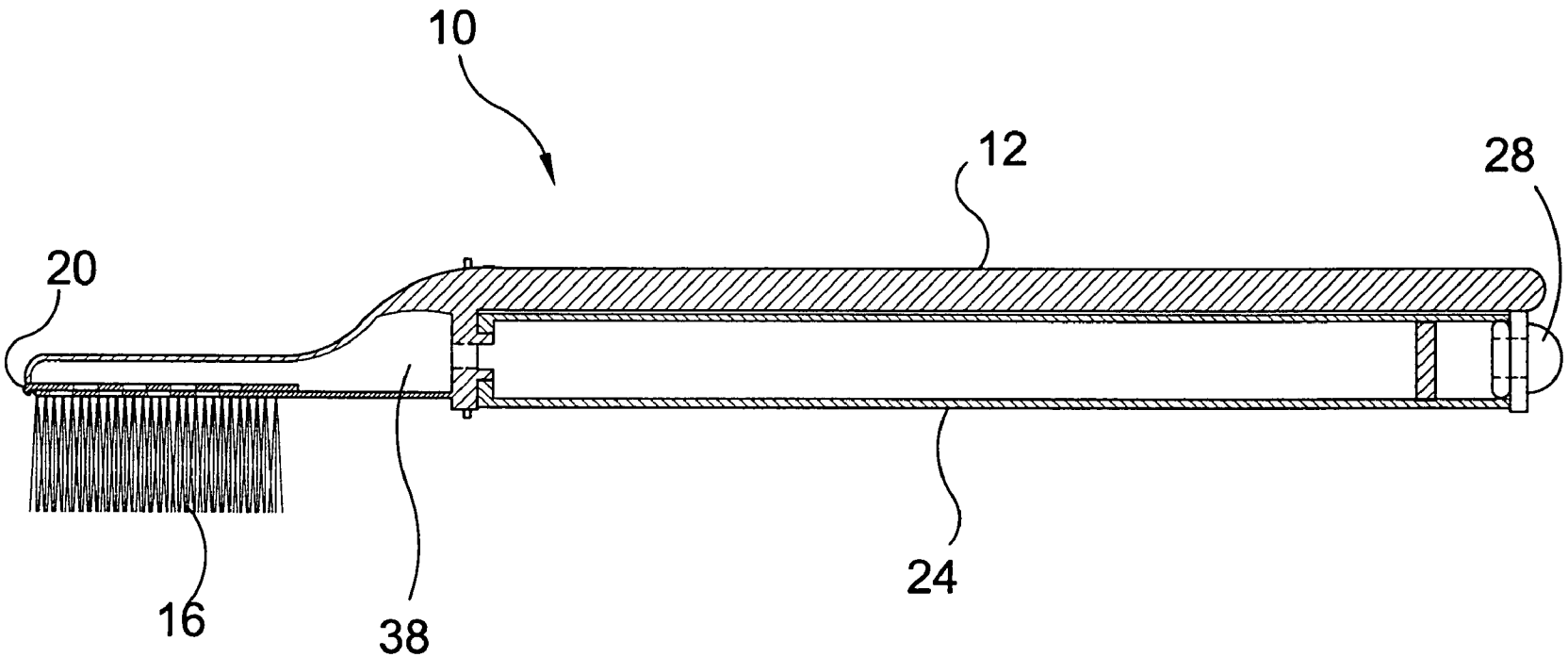
FIG. 11 is a sectional view of an additional element of the present invention.

FIG. 11 is a sectional view of an additional element of the present invention 10. Shown is an additional element of the present invention 10 comprising a toothbrush toothpaste combination device having a handle 12 with a tooth brush bristle portion at one end and an injector pump 28 at the other end. On the lower portion of the handle a cartridge housing is provided to receive a tooth paste cartridge 24 therein. With cartridge 24 loaded, pressure applied on the injector pump 28 will force the toothpaste into the bristles 16, provided the open/close slide 20 is in the open position. The dispenser slide 20, when in the closed position, prevents over flow of toothpaste when not in use.

Figure 12:
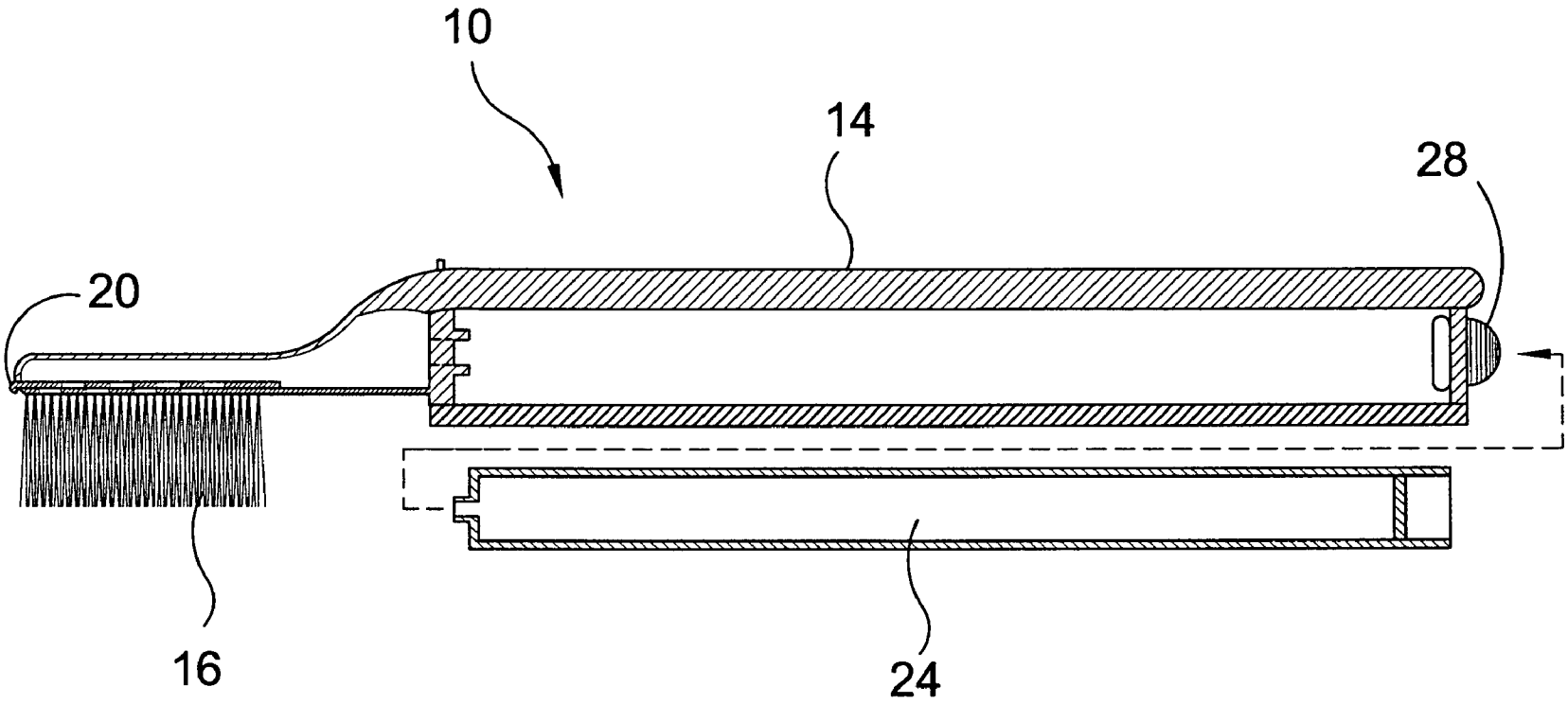
FIG. 12 is an exploded sectional view of the present invention.

FIG. 12 is an exploded sectional view of the present invention 10. Shown is an additional element of the present invention comprising a toothbrush toothpaste combination device having a handle 12 with a toothbrush bristle portion at one end and an injector pump 28 at its other end. On the lower portion of the handle 12 a cartridge housing is provided to receive a toothpaste cartridge 24 therein. With cartridge 24 loaded, pressure applied on the injector pump 28 will force the toothpaste into the bristles 16, provided the open/close slide is in the open position. The dispenser slide 20, when in the closed position, prevents over flow of toothpaste when not in use.

Figure 13:
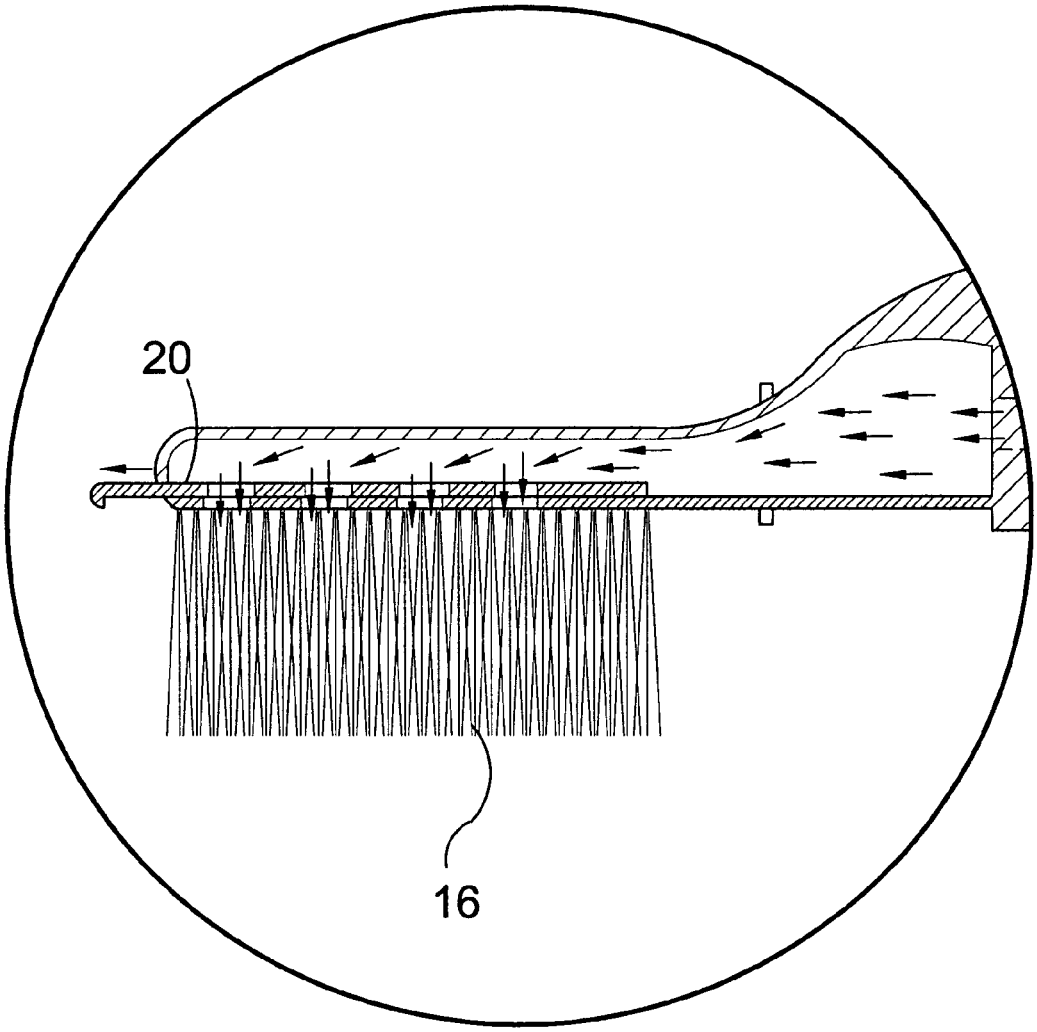
FIG. 13 is a detailed view of the sliding tab of the present invention shown in the open position.

FIG. 13 is a detailed view of the sliding tab 20 of the present invention shown in the open position. Shown is an additional element of the present invention comprising a toothbrush toothpaste combination device having a handle with a toothbrush bristle portion at one distal end and an injector pump at its other distal end. On the lower portion of the handle a cartridge housing is provided to receive a toothpaste cartridge therein. With cartridge loaded, pressure applied on the injector pump will force the toothpaste into the bristles 16, provided the open/close slide 20 is in the open position. The dispenser slide 20, when in the closed position, prevents over flow of toothpaste when not in use.

Figure 14:
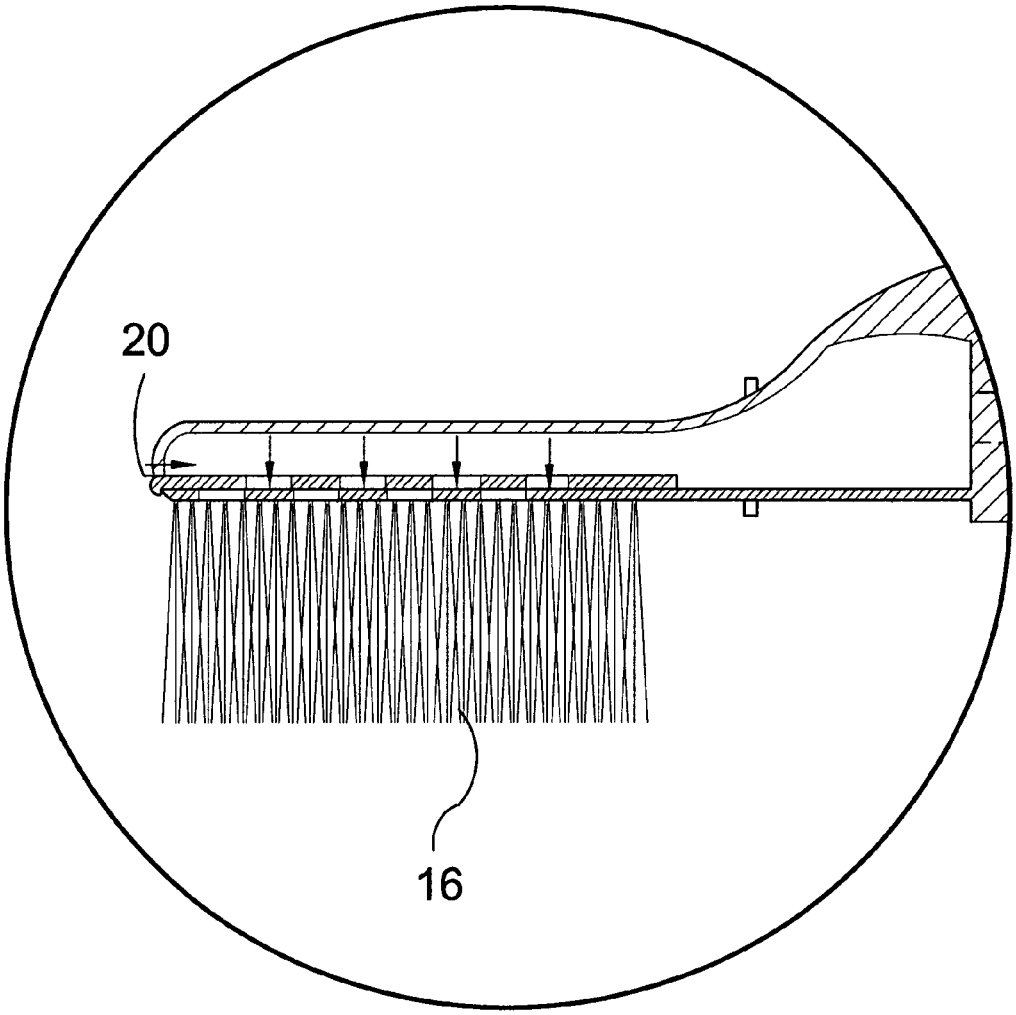
FIG. 14 is a detailed view of the sliding tab of the present invention shown in the closed position.

FIG. 14 is a detailed view of the sliding tab 20 of the present invention shown in the closed position. Shown is an additional element of the present invention comprising a toothbrush toothpaste combination device having a handle with a toothbrush bristle portion at one distal end and an injector pump at its other distal end. On the lower portion of the handle a cartridge housing is provided to receive a toothpaste cartridge therein. With cartridge loaded, pressure applied on the injector pump will force the toothpaste into the bristles 16, provided the open/close slide 20 is in the open position. The dispenser slide 20, when in the closed position, prevents over flow of toothpaste when not in use. A cover cap is provided and clicks into place on ridges encompassing the handle.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various application without omitting features that, from the standpoint of prior art, fairly constitute essential characteristics of the generic or specific aspects of this invention.

What is claimed is new and desired to be protected by Letters Patent is set forth in the appended claims:

1. A toothpaste-dispensing toothbrush comprising:

a) a handle having an elongated free end and an opposite second end;

b) a bristle head with a plurality of bristles extending from one side thereof, said bristle head having one end joined to said opposite second end of said handle and a free second end;

c) a cartridge chamber disposed within said handle;

d) a removable toothpaste cartridge within said cartridge chamber;

e) a conduit extending through an interior portion of said bristle head and in communication with said toothpaste cartridge;

f) a plurality of apertures disposed in said one side of said bristle head providing access from said conduit to said bristles;

g) a slide tab in said bristle head disposed between said conduit and said apertures wherein said slide tab extends beyond said free second end of said bristle head, said slide tab slidable between an almost fully inserted first position and an extended second position where said tab is extended further out of said bristle head, said slide tab having a free end extending out from said bristle head;

h) a plurality of apertures disposed within said slide tab arranged to be offset from said bristle head apertures when said slide tab is in the first position, and the apertures of said tab and said bristle head aligned when said slide tab is in the second position;

i) said slide tab free end having a nub to aid in selective movement of said slide tab, said nub having a hook-like portion directed toward said one side of said bristle head where said bristles extend therefrom to limit movement of said slide tab into said bristle head; and j) means for advancing said toothpaste from said toothpaste cartridge into said conduit said means for advancing disposed on said free end of said handle.

2. A toothpaste-dispensing toothbrush as recited in claim 1, wherein said toothpaste advancing means is a manually operated injector pump.

3. A toothpaste-dispensing toothbrush as recited in claim 2, wherein said toothpaste cartridge further includes a movable platen disposed towards said injector pump wherein a pressurized situation results in said platen responding by moving away from said pump and creating a pressurized condition within said toothpaste cartridge.

4. A toothpaste-dispensing toothbrush as recited in claim 3, wherein said toothpaste cartridge is removable and may be replaced when empty.

5. A toothpaste-dispensing toothbrush as recited in claim 4, further including a cap member that can be removably secured to said bristle head to protect said bristles from exterior contaminants.

6. A toothpaste-dispensing toothbrush as recited in claim 5, wherein said cap retaining means is a cap ridge extending from said bristle head to provide for the frictional engagement of said cap member thereto.

* * * * *